US007561698B1

(12) United States Patent
Pomerantz

(10) Patent No.: US 7,561,698 B1
(45) Date of Patent: Jul. 14, 2009

(54) AUTO SHUTOFF FOR PORTABLE AUDIO DEVICES

(75) Inventor: Ori Pomerantz, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/191,617

(22) Filed: Aug. 14, 2008

(51) Int. Cl.
*H04R 29/00* (2006.01)

(52) U.S. Cl. ..... 381/58; 381/56; 381/123

(58) Field of Classification Search ..... 381/56–59, 381/95, 96, 123, 111–113, 116, 77, 79, 81, 381/85; 700/94; 361/679, 683, 686
See application file for complete search history.

(56) References Cited

U.S. PATENT DOCUMENTS 4,975,964 A * 12/1990 Hochstein ..... 381/110
5,636,077 A 6/1997 Kim
6,148,353 A * 11/2000 Cho ..... 710/303
6,191,505 B1 * 2/2001 Matsuyama ..... 307/130
7,120,403 B2 10/2006 Cohen et al.
2005/0063556 A1 * 3/2005 McEachen et al. ..... 381/104
2007/0078552 A1 * 4/2007 Rosenberg ..... 700/94
2008/0255690 A1 * 10/2008 Wong et al. ..... 700/94
2009/0003619 A1 1/2009 Solow

FOREIGN PATENT DOCUMENTS

WO WO/97/09756 A2 3/1997

* cited by examiner

*Primary Examiner*—Xu Mei
(74) *Attorney, Agent, or Firm*—Shimokaji & Associates, P.C.

(57) ABSTRACT

A system for automatically shutting of a portable audio player is disclosed. A portable audio player includes a microphone, an audio detector and a processor. The portable audio player may be connected to external speakers for outputting an audio signal played by the portable audio player. The microphone and audio detector may monitor audio signal output from the external speakers check if the external speakers cease outputting an audio signal. A processor may compare an audio signal value generated by the audio detector based on the audio signal output of the external speakers. When the audio signal value drops below a threshold value, a switch on the portable audio player is activated to power off the portable audio player.

1 Claim, 2 Drawing Sheets

AUTO SHUTOFF FOR PORTABLE AUDIO DEVICES

BACKGROUND OF THE INVENTION

The present invention is related to the field of audio players and, more particularly, to a system for automatically shutting off portable audio players.

Some people have found increasing popularity in the use of portable audio players. The relatively small packaging combined with relatively large data storage has enamored some people to not only carry portable audio players on their person, but to use portable audio players to replace some larger home audio equipment. Home use of portable audio players may be attributed to developments in portable audio player accessories. Some accessories include docking stations or hubs that may serve as an intermediary between the portable audio player and a speaker system. In some cases, the docking stations include playing portable audio player files as only one of a number of functions. For instance, some docking stations may also include FM/AM tuners, a compact disc player, etc. Thus, the docking station and portable audio player may have entirely independent power sources.

In some cases, a person may power up both the docking station and portable audio player to listen to music files from the portable audio player. Subsequently, content with having heard enough music from the portable audio player, the person may shut off the docking station yet forget to power off the portable audio player leaving it to run and expend its battery capacity.

It is known in the art to shut off a device when input has ceased for a predetermined amount of time. For example, computer monitors may include a sleep mechanism to power off the video output when a user has delayed too long in using interfaces in connection with the computer. However, some portable audio players may be designed to continuously play music files regardless of the last time a user interfaced with the device's input mechanisms.

It is also known in the art to monitor the impedance on speaker lines for determining if an audio signal is present. Impedance may depend on the uniformity of connections among speakers. When measuring impedance, it may be difficult to evaluate the variance of impedance between speakers where some speaker wires have less stable connections or there are differences in wire qualities.

Hence, there is a need for a system for automatic shutoff of portable audio players.

SUMMARY OF THE INVENTION

A system for automatic shutoff comprises, a portable audio player for transmitting an audio signal; a user input mechanism for selecting functions and settings on the portable audio player; an external speaker system connected to the portable audio player for transmitting an audio signal output of the audio signal; a microphone attached to the portable audio player for receiving the audio signal output emanating from the speaker system and for reproducing the audio signal from the audio signal output; an audio detector connected to the microphone for assigning an audio signal value to the audio signal received from the microphone; a processor for storing an audio signal threshold value and a file copy of the audio signal and for comparing the audio signal value received from the audio detector to the stored file copy; a switch mechanism in the portable audio player for powering down the portable audio player, which is activated when the audio signal value fails to correlate to the stored file copy according to the audio signal threshold level value for a predetermined duration; and an audio signal threshold setting function in connection with the processor for setting the audio signal threshold value and for setting the predetermined duration as set by a user using the user input mechanism.

These and other features, aspects and advantages of this invention of the present invention will become better understood with reference to the following drawings, description, and claims

DETAILED DESCRIPTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Figure 1:
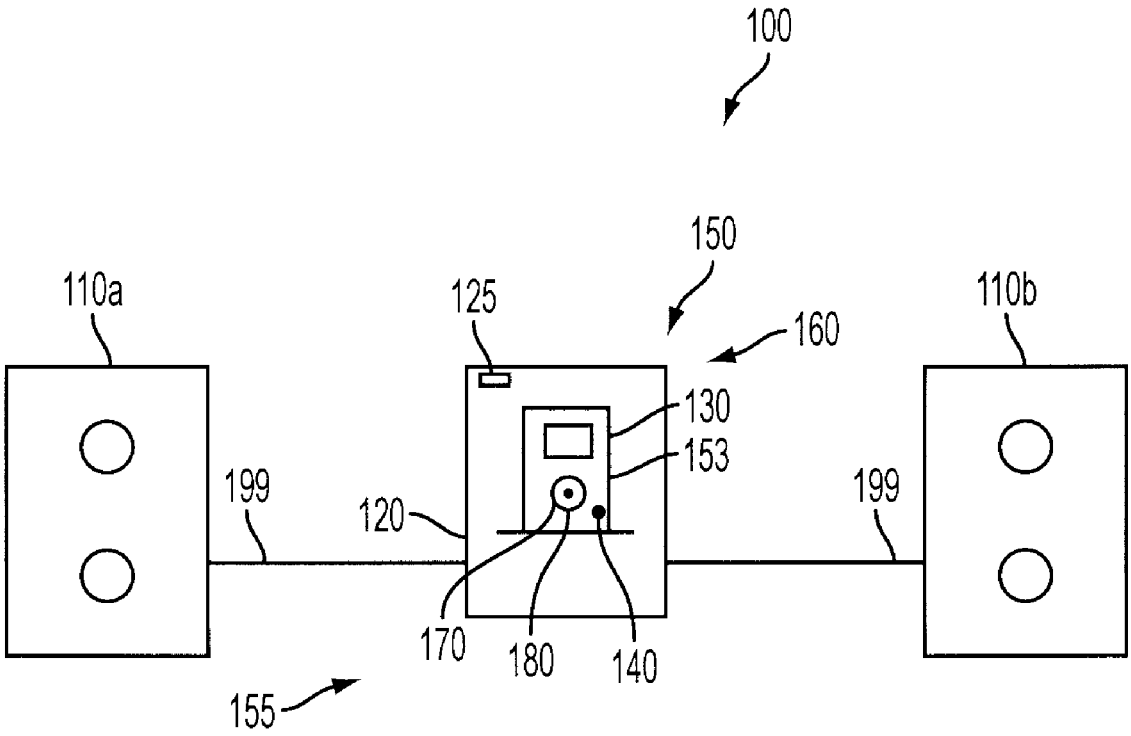
FIG. 1 illustrates a system for automatic shutoff of a portable player in accordance with the principles of the invention.
Figure 2:
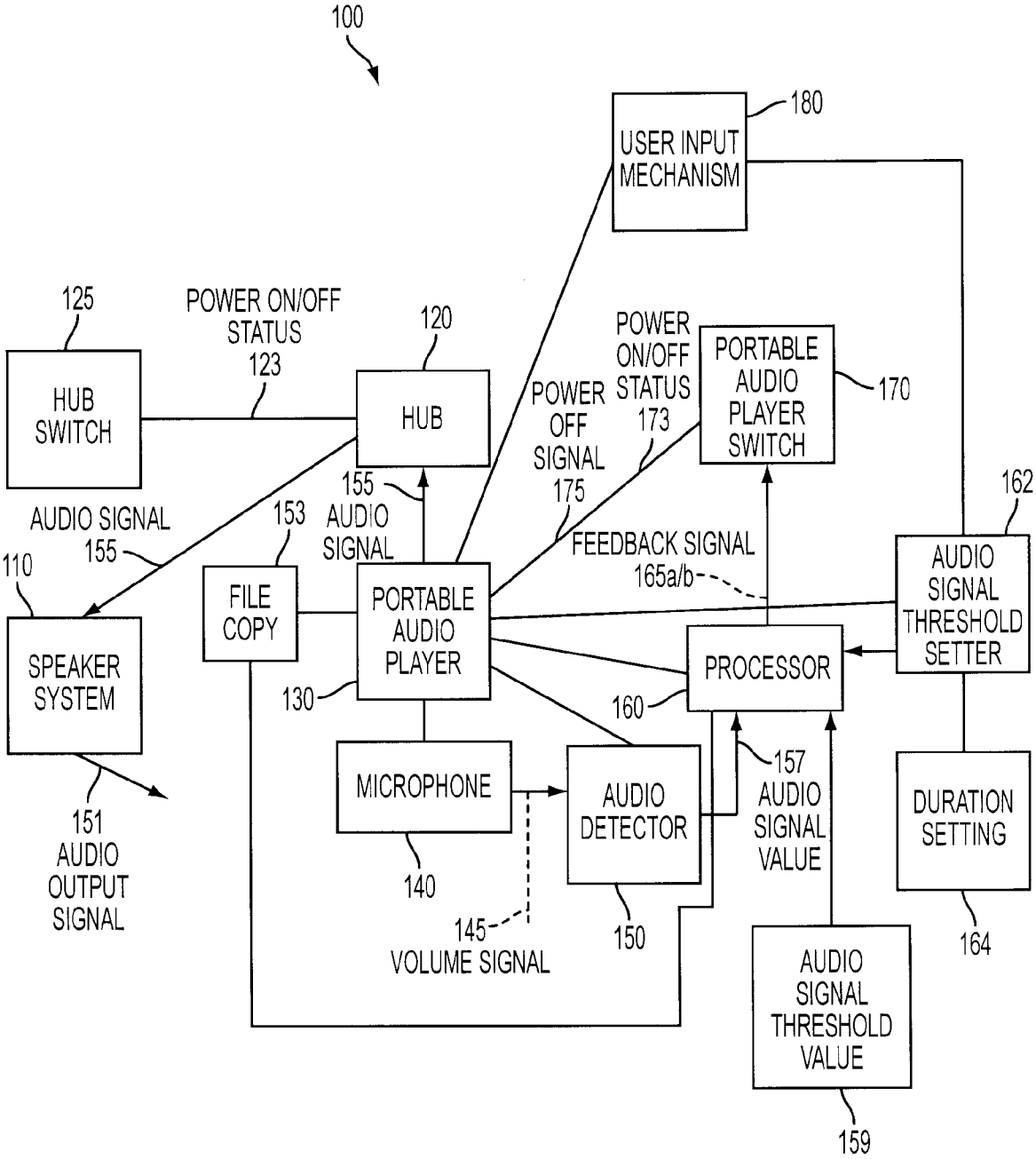
FIG. 2 depicts a block diagram of the system in FIG. 1.

With reference to FIGS. 1 and 2, an exemplary embodiment of the present invention is described. FIG. 1 depicts a system 100 according to the present invention. The system 100 may include an audio hub 120, a speaker system 110, audio wires 199, a portable audio player 130, and a microphone 140. The speaker system 110 may include, in one exemplary embodiment, a pair of speakers 110*a* and 110*b* connected to the audio hub 120 by audio wires 199. The portable audio player 130 may be compatible for docking within the audio hub 120 where the audio hub 120 may receive an audio signal 155 for audio emission out of the speaker system 110. The portable player 130 may, for example, be an MP3 format playing player such as an iPod™ or Sansa™. The portable audio player 130 may additionally include an audio detector 150, a processor 160, a portable audio player switch 170, and a user input mechanism 180. It will be understood that the audio detector 150 and a processor 160 may be housed within the portable audio player 130 hidden from external view. The portable audio player switch 170 may be used to power on or off the portable audio player 130. The hub 120 may also include a hub switch 125 for similar powering on or off of the hub 120. The user input mechanism 180 may be used as a user interface for selecting, for example, functions and settings (not shown) on the portable audio player 130. It will be understood that the user input mechanism may also be enabled to function as the portable audio player switch 170.

In operation and with reference to FIG. 2, the system 100 may detect changes in an audio signal 155 coming from the portable audio player 130. In an exemplary operation of the system 100, the portable audio player 130 may be docked in the audio hub 120. The operation of the hub switch 125 may control the power on/off status 123 of the audio hub 120. Similarly, the portable audio player switch 170 may control the power on/off status 173 of the portable audio player 130. It will be understood that the power on/off status 173 may be independent of the power on/off status 123. Thus, when the audio hub 120 and the portable audio player 130 may both be turned on, the portable audio player 130 may transmit an audio signal 155 to the audio hub 120 which, in turn, retransmits the audio signal 155 to the external speaker system 110. The speaker system 110 in turn, may broadcast an audio output signal 151 into the surrounding environment. The microphone 140 may receive the audio output signal 151 and transmit a volume signal 145 representing the audio output signal 151 to the audio detector 150. The audio detector 150, in turn, may monitor the microphone 140 for the volume signal 145 and transmit an audio signal value 157 based on the volume signal 145 to the processor 160. Within the processor 160, an audio signal threshold value 159 may be stored. When the processor 160 receives the audio signal value 157, the processor 160 may perform a comparison between the audio signal threshold value 159 and audio signal value 157.

In exemplary cases where the audio signal value 157 meets or exceeds the audio signal threshold value 159, a feedback signal 165*a* may be transmitted to the portable audio player switch 170 indicating that the speaker system 110 is outputting an audio output signal 151 and the power on/off status 173 should remain on.

In exemplary cases where the speaker system is off, the audio output signal 151, if any exists at all, may produce a volume signal 145 that registers as an audio signal value 157 falling short of the audio signal threshold value 159. In response, a feedback signal 165*b* may be transmitted to the portable audio player switch 170 indicating that the speaker system 110 is not outputting an audio output signal 151. Upon receipt of a feedback signal 165*b*, the portable audio player switch 170 may activate a power off command 175 powering off the portable audio player 130. In another embodiment of the system 100, the portable audio player 130 and processor 159 may also include an audio signal threshold setting function 162. The audio signal threshold setting function 162 may allow one to set the audio signal threshold value 159 level and a duration 164 for which the audio signal value 157 may fall below the audio signal threshold value 159. The audio signal threshold setting function 162 may be set using the user input mechanism 180.

In another exemplary embodiment, the processor 160 may also perform a matching correlation of the audio signal 155 to the audio signal threshold value 159 in cases where the system 100. In this exemplary embodiment, the processor 160 may store a file copy 153 of the audio signal 155. As the audio signal output 151 is received by the microphone 140, the audio signal output 151 may be retransformed back into the audio signal 155. The audio detector 150 may assign an audio signal value 157 to the audio signal 155 and transmit audio signal values 157 to the processor 160. As the processor 160 receives audio signal values 157, it may compare the audio signal values 157 to the stored file copy 153. In this exemplary embodiment, the audio signal threshold value 159 may represent a direct correlation of the audio signal value 157 to the stored file copy 153. Thus, if enough of the audio signal 155 is picked up by the microphone 140, then the audio signal value 157 may match closely enough the stored file copy 153 and the audio signal threshold value 159 may be met. However, in a scenario where the speaker system 110 is turned off, the audio signal 155 picked up by the microphone 140 may produce an audio signal value 157 that may not correlate closely enough to the stored file copy 153. Thus, the audio signal threshold value 159 may not be met and the portable audio player switch 170 may activate the power off command 175 powering off the portable audio player 130

While the foregoing has been described in the context of a system 100 including an audio hub 120, it will be understood that the system 100 may also operate as a system including the speakers 110*a* and 110*b* connected directly to the portable audio player 130. In such an exemplary embodiment, it will be appreciated that the built-in microphone 140 may still monitor the presence of an audio output signal 151 from the speakers 110*a* and 110*b* and control the power on/off status 173 of the portable audio player 130 accordingly.

It will also be understood that while the foregoing was described in the context of portable audio players using MP3 formats, that portable audio players using other formats may also be used in the system 100. For example, some other formats may include AAC, WMA, and MPEG4.

It should be understood, of course, that the foregoing relates to exemplary embodiments of the invention and that modifications may be made without departing from the spirit and scope of the invention as set forth in the following claims.

What is claimed is:

1. A system for automatic shutoff, comprising:

a portable audio player for transmitting an audio signal;

a user input mechanism for selecting functions and settings on the portable audio player;

an external speaker system connected to the portable audio player for transmitting an audio signal output of the audio signal;

a microphone attached to the portable audio player for receiving the audio signal output emanating from the speaker system and for reproducing the audio signal from the audio signal output;

an audio detector connected to the microphone for assigning an audio signal value to the audio signal received from the microphone;

a processor for storing an audio signal threshold value and a file copy of the audio signal and for comparing the audio signal value received from the audio detector to the stored file copy;

a switch mechanism in the portable audio player for powering down the portable audio player, which is activated when the audio signal value fails to correlate to the stored file copy according to the audio signal threshold level value for a predetermined duration; and an audio signal threshold setting function in connection with the processor for setting the audio signal threshold value and for setting the predetermined duration as set by a user using the user input mechanism.

* * * * *